United States Patent [19]

Roberts

[11] 4,044,705

[45] Aug. 30, 1977

[54] OUTBOARD MOTOR MOUNTING ASSEMBLY AND SERVO MECHANISM THEREFOR

[75] Inventor: William Roberts, Tavernier, Fla.

[73] Assignee: Ross D. Siragusa, Barrington, Ill.

[21] Appl. No.: 670,431

[22] Filed: Mar. 25, 1976

[51] Int. Cl.[2] ..... B63H 5/12

[52] U.S. Cl. ..... 115/41 HT; 248/4

[58] Field of Search ..... 115/41, 18 R, 17; 248/4

[56] References Cited

U.S. PATENT DOCUMENTS

| | | | |
|---|---|---|---|
| 2,713,842 | 7/1955 | Plouff | 115/41 R |
| 2,775,219 | 12/1956 | Curtis | 115/41 R |
| 3,096,959 | 7/1963 | Wagner | 115/41 R |
| 3,809,343 | 5/1974 | Adams et al. | 115/17 |

*Primary Examiner*—Trygve M. Blix
*Assistant Examiner*—Sherman D. Basinger
*Attorney, Agent, or Firm*—Hill, Gross, Simpson, Van Santen, Steadman, Chiara & Simpson

[57] ABSTRACT

This invention relates to an outboard motor assembly and servo mechanism therefor, and particularly to one in which the motor, propeller drive shaft and propeller can quickly and easily be raised as a unit to locate the propeller at a position where the propeller will not cause cavitation at very slow speeds and where it will reduce the draft required for the boat on which the motor is mounted, but at the same time permits immediate lowering of the propeller to a position for high speed operation when deeper water is reached. The above is accomplished by providing an auxiliary transom adjacent the main transom which is mounted for limited reciprocal movement in substantially a vertical direction by a servo mechanism, preferably under the control of the operator of the boat. This enables the boat propulsion means to be quickly changed from a position for slow speed operation to a position for high speed and vice versa.

1 Claim, 7 Drawing Figures

Fig. 1
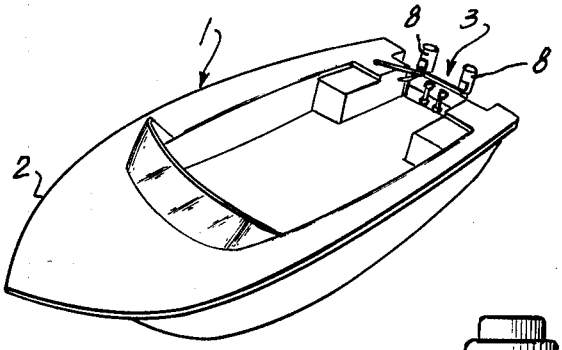
Fig. 2
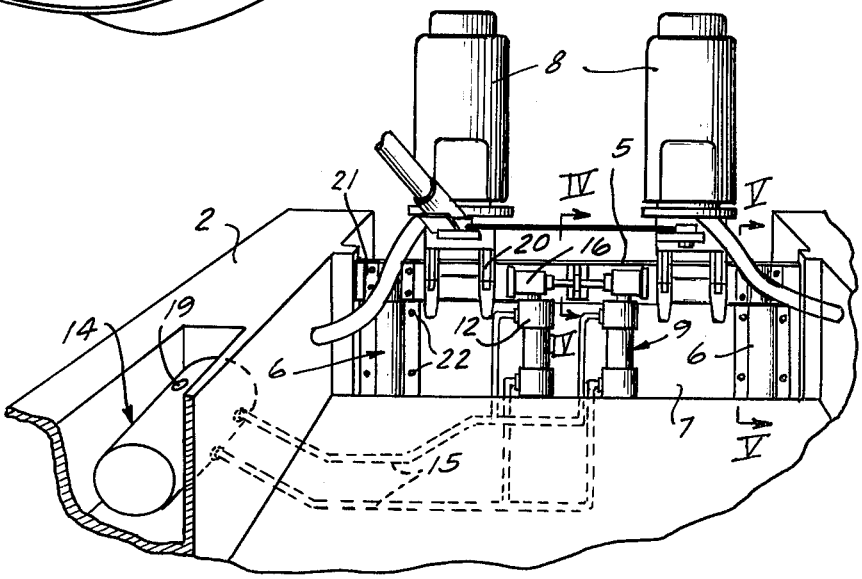
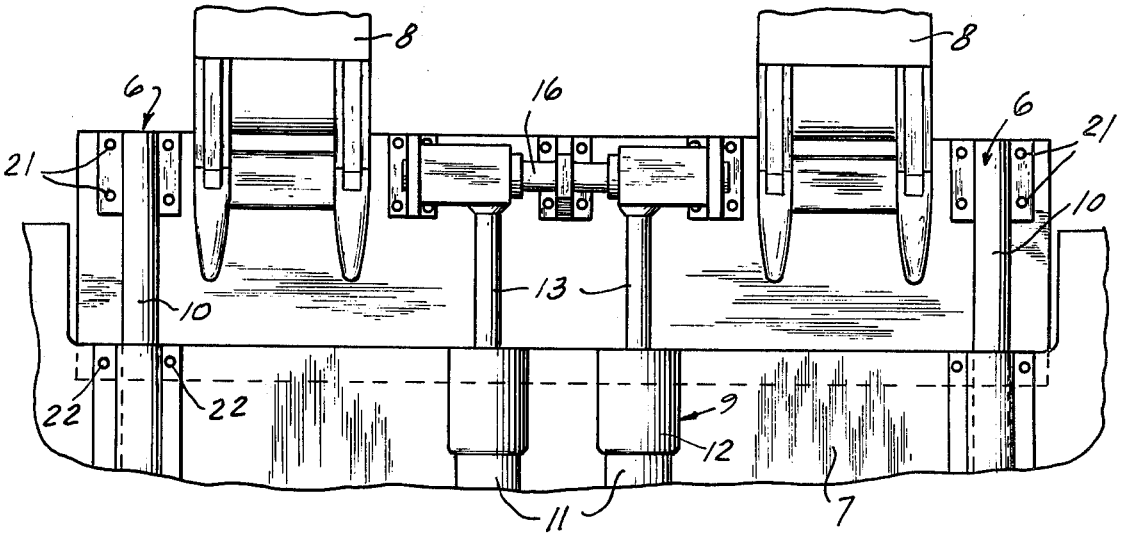
Fig. 3

Fig-4
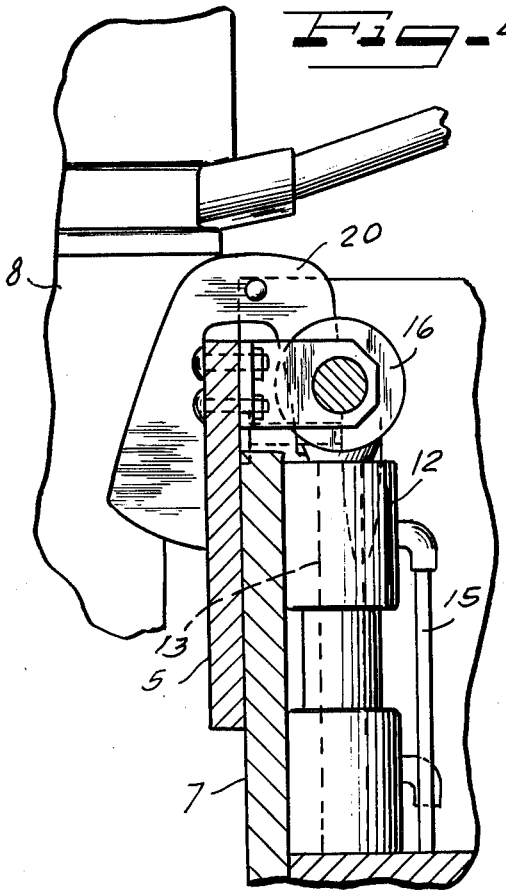
Fig-5
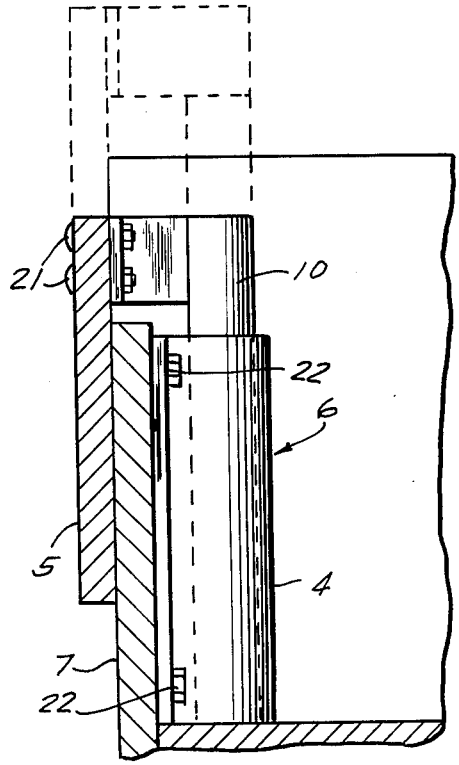
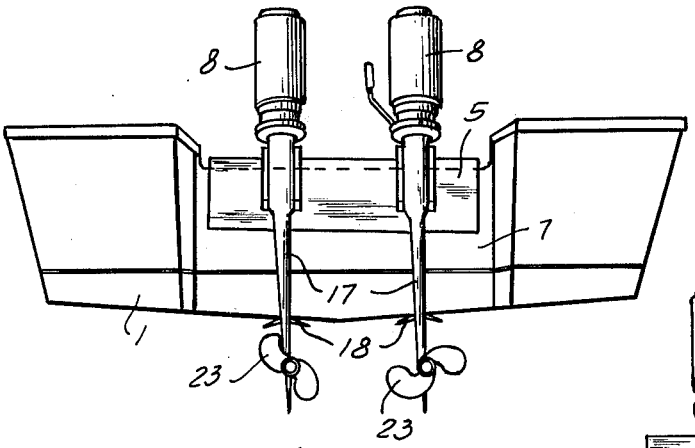
Fig-6
Fig-7
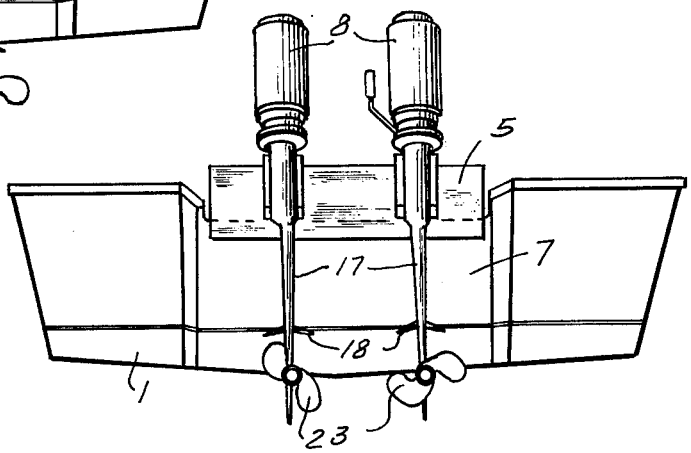

OUTBOARD MOTOR MOUNTING ASSEMBLY AND SERVO MECHANISM THEREFOR

BACKGROUND OF THE INVENTION

1. Field of the Invention

The present invention relates to a mounting arrangement for supporting one or more outboard motors on a boat and to means for supporting such motor or motors in two different positions, one of which being for navigation through shallow waters, and the other for navigation in relatively deep waters.

2. Prior Art

It has been recognized that for operating a boat such as a fishing boat in very shallow water, the propeller axis should preferably be at a point no lower than the bottom of the boat. However, navigation of the boat in deeper waters usually has the propeller located well below the bottom of the boat. If a propeller mounted for high speed in deep water is driven at slow speeds, cavitation occurs.

It is also known that a single motor may be mounted for one or the other of the above operations by employing a two-piece transom hinged for movement about a horizontal axis where the upper half may be folded back on the lower half. The motor can then be either mounted on the upper half when not folded back or hung on the folded transom. This provides a positioning of the propeller in one of two positions, one for slow speed operation and one for high speed operation. It is not a convenient arrangement, however, since it is difficult to dismount the motor from the transom and lift it either to bring the transom into its folded back position or in its extended upright position.

SUMMARY OF THE INVENTION

It is an object of the present invention to provide a novel outboard motor assembly and servo mechanism for shifting the vertical position of the outboard motor and its propeller between one of two different vertical positions.

It is a further object of the present invention to provide a novel mounting assembly for an outboard motor which enables the outboard motor to be raised as a unit to locate the propeller at a position where the propeller will not cause cavitation at very slow speeds, and where it will reduce the draft required for slow speed boat operation but which will, at the same time, permit immediate lowering of the propeller to a position where it may be driven at high speeds promptly upon movement of the boat out of the area of shallow water. The above is accomplished by providing an auxiliary transom adjacent the main transom which is mounted for limited reciprocal movement in substantially a vertical direction by a servo mechanism under the control of the operator, which control is preferably hydraulic. This enables the boat propulsion means to be quickly changed from a position for slow speed operation to a position for high speed and vice versa.

It has been found preferable that the vertical shift of the motor and its associated propeller be limited to a maximum of approximately 3¾ inches.

The arrangement is readily adaptable to both electric outboard motors as well as outboard motors of the internal combustion type. While it is believed practical to accommodate power plants of up to 40 horse power, it is considered best for use with motors of approximately 10 horse power or less.

When the servo mechanism is a hydraulic system, it is powered by a hydraulic pump mounted in the boat.

BRIEF DESCRIPTION OF THE DRAWINGS

FIG. 1 is a diagrammatic view generally depicting a boat which includes a servo-mechanical assembly unit in accordance with the invention;

FIG. 2 is a partial diagrammatic view depicting in detail the stern of a boat equipped with the novel mounting means and servo mechanism of a preferred embodiment of the present invention;

FIG. 3 is a detailed fragmentary diagrammatic view depicting a servo-mechanical assembly unit in a raised position in accordance with the invention;

FIG. 4 is a side view partly in section taken along the line IV—IV of FIG. 2 in accordance with the invention;

FIG. 5 is a side view partially in section taken along the line V—V of FIG. 2;

FIG. 6 is a stern view of a boat embodying the invention showing the motors in their lower position; and FIG. 7 is a stern view of a boat embodying the invention showing the motors in their raised position.

DESCRIPTION OF THE PREFERRED EMBODIMENT

A preferred embodiment of the present invention will now be described with reference to the various figures of the drawings. The invention is particularly adapted for use with an outboard motor boat such as that illustrated as 1 in FIG. 1 of the drawings. This boat 1 includes a hull 2 having a stern 3, which stern is formed by a main transom 7 and an auxiliary transom 5. One of the principal features of the present invention involves the provision of this auxiliary transom 5 which is slidably mounted over the main transom 7 of the boat (see FIGS. 4 and 5). This auxiliary transom 5 is carried in tractable guides secured to the inner wall of the main transom 7. Two outboard motors 8 are hung on the top of the auxiliary transom 5.

While two outboard motors are shown, it will be obvious that the invention equally includes the mounting of a single outboard motor or indeed of more than two outboard motors.

An interlocking guide rail assembly 6 confines the auxiliary transom 5 to sliding movement overlapping and in surface contact with main transom 7. The guide rail assembly includes a pair of C-shape channels 4 into which support members 10 slidably extend in a close fit. It will thus be apparent that the interlocking guide rail assembly 6 keeps the auxiliary transom 5 in close sliding contact with the outer face of the main transom 7. Support members 10 are secured to the auxiliary transom 5 by bolts 21. The C-shape channels 4 are secured to the main transom by bolts 22.

The auxiliary transom 5 is arranged to be raised and lowered through the means of a hydraulic servo mechanism which includes hydraulic lifts 9 mounted on the main transom 7. The cylinders of the hydraulic lift are designated as 11 (FIG. 3), and these are provided with headers 12. The hydraulic lifts 9 are provided with pistons 13 which are secured through a horizontal collar to a lifting bar 16 supported on the auxiliary transom 5 by brackets. The hydraulic lifts 9 are connected through fluid pressure lines to a fluid pressure pump 14, whose supply of fluid under pressure to the lifts 9 is under the control of a control knob 19, which also controls the relief of pressure in the lifts 9 when the auxiliary transom is to be lowered.

The outboard motors 8 are hung on the auxiliary transom by means of the hanging brackets 20.

The two different positions of the outboard motors and their associated propellers are illustrated in FIGS. 6 and 7. FIG. 6 shows the auxiliary transom 5 in its lowered position where the propellers are an appreciable distance below the bottom of the boat 1. As shown, the drive shafts (not shown) which extend from the motors 8 to their associated propellers are located within the housing 17, and foils 18 extending laterally from the propeller shaft housing 17 are located approximately at the bottom of the boat when the outboard motors and their associated propellers are in the lowered position. As shown in FIG. 7, the auxiliary transom 5 is in its raised position which elevates the outboard motors 8 and simultaneously, of course, the propellers 23. It will be noted that the foils 18 are above the bottom of the boat in this raised position, and in fact, at approximately the water line of the boat.

It will be apparent to those skilled in the art that many modifications and variations may be effected without departing from the spirit and scope of the novel concepts of the present invention.

I claim as my invention:

1. An outboard motor mounting assembly for use on a boat to be powered by outboard-type motors and/or engines, comprising an assembly body, an auxiliary transom carried by said body and having a selected width to conform with a width dimension of a transom of said boat, said auxiliary transom positioned on an outside of said boat transom and having an inner vertical face aligned with an outer vertical face of said boat transom, interlocking guide rail means including a pair of support members having a top horizontal portion with an outer end thereof secured to a top inner side of said auxiliary transom and a vertical slide portion having a top end carried by an inner end of said horizontal portion, one each of said members positioned along each outer vertical edge of said auxiliary transom, and a pair of elongated C-shaped channels secured to an inner face of said boat transom and positioned to receive, in a telescoping relationship, one each of said vertical slide portions of said support member respectively, raising and lowering means including, two spaced hydraulic lifting cylinders secured to said inner face of said boat transom and vertically positioned to provide a mounting space for said outboard motor between said cylinders and said interlocking guide rail means, piston means carried by each cylinder and limited to a $3\frac{3}{4}$ inch stroke, said pistons having top ends joined to a horizontal collar, and an elongated horizontal lifting bar disposed in said collars and supported by brackets attached along said top edge of said inner face of said auxiliary transom between said collars and at ends of said bar, respectively, a fluid pumping means operatively connected to said lifting cylinders to allow a user, from a remote location, to selectively move said top edge of said transom from a deep water position wherein said top edge proximately aligns with a top edge of a boat transom to a shallow water position proximately $3\frac{3}{4}$ inches thereabove, wherein motors carried by said auxiliary transom can be selectively moved from a deep water, high speed configuration to a shallow water, slow speed configuration without affecting cavitation during operation.

* * * * *